US005188030A

United States Patent [19]

Puschnerat et al.

[11] Patent Number: 5,188,030

[45] Date of Patent: Feb. 23, 1993

[54] INKING ROLLER FOR A LITHOGRAPHIC PRINTING MACHINE

[75] Inventors: Helmut Puschnerat, Worms; Walter Reutter, Frankenthal; Walter Unverzagt, Grünstadt, all of Fed. Rep. of Germany

[73] Assignee: Albert-Frankenthal Aktiengesellschaft, Wurzburg, Fed. Rep. of Germany

[21] Appl. No.: 873,174

[22] Filed: Apr. 24, 1992

[30] Foreign Application Priority Data

Apr. 27, 1991 [DE] Fed. Rep. of Germany ..... 4113903

[51] Int. Cl.[5] ..... B41F 31/26

[52] U.S. Cl. ..... 101/348; 29/895.32; 205/195; 205/223; 492/30

[58] Field of Search ..... 101/148, 348, 450.1, 101/451; 29/121.1-121.8, 895.32; 205/127, 195, 223

[56] References Cited

U.S. PATENT DOCUMENTS

| | | | |
|---|---|---|---|
| 4,287,827 | 9/1981 | Warner | 101/141 |
| 4,601,242 | 7/1986 | Fadner | 101/348 |
| 4,637,310 | 1/1987 | Sato et al. | 101/348 |
| 4,860,652 | 8/1989 | Kawata | 101/348 |
| 4,879,791 | 11/1989 | Herb | 101/348 |
| 5,099,759 | 3/1992 | Sonobe et al. | 101/348 |
| 5,113,760 | 5/1992 | Sonobe et al. | 101/348 |

FOREIGN PATENT DOCUMENTS

| | | | |
|---|---|---|---|
| 0350434 | 7/1988 | European Pat. Off. . | |
| 3713027 | 4/1987 | Fed. Rep. of Germany . | |
| 42463 | 3/1983 | Japan | 101/348 |
| 56856 | 4/1983 | Japan | 101/348 |

*Primary Examiner*—Clifford D. Crowder
*Assistant Examiner*—Stephen R. Funk
*Attorney, Agent, or Firm*—Jones, Tullar & Cooper

[57] ABSTRACT

A roller for a printing machine is formed having oleophilic metal cells and hydrophilic ceramic cross pieces. The ceramic material is applied to the outer surface and is then ground away to again expose the metal. An upper portion of the metal is then removed to leave the elevated hydrophilic ceramic cross pieces.

3 Claims, 1 Drawing Sheet

INKING ROLLER FOR A LITHOGRAPHIC PRINTING MACHINE

FIELD OF THE INVENTION

The present invention is directed generally to a roller for a printing machine. More particularly, the present invention is directed to a roller with a surface which consists of hydrophilic and oleophilic surfaces. Most particularly, the present invention is directed to a roller having hydrophilic and oleophilic surface portions and to a method of making a roller having such a surface. A surface layer of an oleophilic material is placed on a roller or on a roller encircling sleeve. A plurality of indentations are then formed on the outer surface of the oleophilic metal layer. The entire outer surface of the roller, including the indentations, is backfilled with a hydrophilic material. This layer is then milled down to expose the top of the oleophilic metal. This metal is then further removed to leave its surface below that of the hydrophilic material that was backfilled into the indentations.

DESCRIPTION OF THE PRIOR ART

Screened surface ink rollers, that are usable in printing machines, are known generally in the art. These screened surface rollers have a surface portion which consists of cells and cross pieces. One such screened surface ink roller may be seen in German patent specification No. 37 13 027 C2. This patent specification discloses a screened surface ink roller in which the surfaces of the cells are coated with an oleophilic plastic material or metal and the cross pieces consist of a hydrophilic material, such as a ceramic material. These prior art screened surface ink rollers are apt to be difficult and costly to manufacture and have often had a relatively short usable life. Frequently, once the raised cross pieces have been worn down to the level of the cells, the screened surface ink rollers have been discarded.

It will thus be apparent that a need exists for a screened surface ink roller that has oleophilic cells and hydrophilic cross pieces which is relatively easily and inexpensively manufactured and which can be refurbished for reuse. The roller for a printing machine in accordance with the present invention provides such a device and is a significant improvement over the prior art devices.

SUMMARY OF THE INVENTION

It is an object of the present invention to provide a roller for a printing machine.

Another object of the invention is to provide an inking unit roller having a surface of oleophilic cells and hydrophilic cross pieces.

A further object of the present invention is to provide a method of manufacturing a roller for a printing machine.

Still another object of the present invention is to provide a method of manufacturing a inking unit roller having a surface of oleophilic cells and hydrophilic cross pieces.

Yet a further object of the present invention is to provide a screened ink roller which can be refurbished and reused.

Even still another object of the present invention is to provide a screened surface ink roller that is inexpensive and uncomplicated to manufacture.

As will be discussed in greater detail in the description of the preferred embodiment which is set forth subsequently, the roller for a printing machine in accordance with the present invention utilizes an oleophilic metal layer on the outer surface of a steel roller or a metal sleeve that can be slid over the periphery of a roller. A plurality of indentations are formed in the outer surface of the oleophilic metal layer. These indentations are backfilled with a hydrophilic material, such as a ceramic material. A thin layer of this ceramic material is also applied to the outer surface of the oleophilic metal layer. The surface of the ceramic coated roller is then milled or otherwise cut away to again expose the oleophilic metal layer in all areas except the backfilled indentations. The depth of the oleophilic metal layer can then be reduced by chemical etching or the like to create the oleophilic cells which are separated by the higher hydrophilic cross pieces.

A primary advantage of the roller for a printing machine in accordance with the present invention is that the roller has cells and cross pieces in which the oleophilic metal cells can, after being washed away or by chemical melting, be easily backfilled up to a set indentation size such as, for example by applying metal through an electrochemical method. Alternatively, if the hydrophilic cross pieces or parts, which are in contact with the doctor blade, are worn down to the level of the oleophilic cells, the level of the cells can be further reduced. This can be accomplished by suitable chemical etching or electrochemical chem-milling until the desired elevational difference between the oleophilic cells and the hydrophilic cross pieces is again attained. This allows the roller for a printing machine in accordance with the present invention to be refurbished. This allows the life of the roller to be prolonged.

The roller for a printing machine in accordance with the present invention overcomes the limitations of the prior art devices and is a substantial advance in the art.

BRIEF DESCRIPTION OF THE DRAWINGS

While the novel features of the roller for a printing machine in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
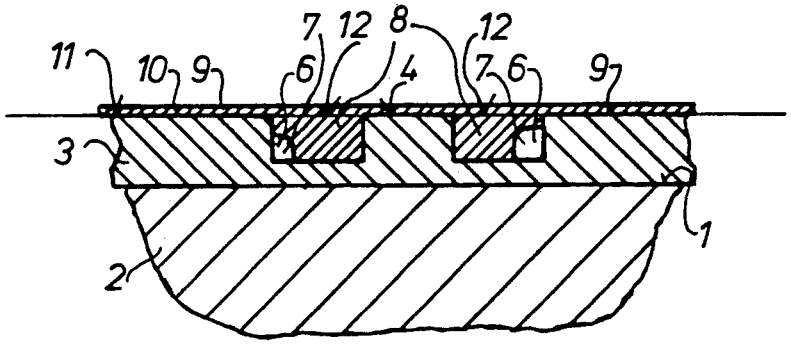
FIG. 1 is a cross-sectional side elevation view of a portion of a roller in accordance with the present invention and showing a roller coating prior to completion of the coating process.

Referring initially to FIG. 1, there may be seen a roller for a printing machine in accordance with the present invention and showing the formation of the coating on the surface of the roller. The peripheral surface 1 of a steel roller 2 or of a metal pipe which can be slid onto a roller is provided with a relatively thick layer 3 of an oleophilic metal, such as, for example, copper. The oleophilic metal layer 3 can be applied to the peripheral surface 1 of steel roller 2 or the metal pipe by any suitable process such as flame spraying, electrochemical application, or other filling process. In a preferred embodiment, the metal layer may be 0.6 mm in thickness.

This oleophilic surface 4 of the metal layer 1 is now provided with a plurality of suitably positioned indentations 6. These indentations 6 are of a sufficient depth that they may extend to the periphery 1 of the steel roller 2 or the steel sleeve. The depth of these indentations 6 may be less than the thickness of the metal layer 3 so that the bottoms of the indentations 6 end in the metal layer 3. These recesses or indentations 6 can have any desired cross-sectional shape and can be formed in the surface 4 of the oleophilic metal layer 3 by a number of different ways such as by turning, rolling, engraving or the like. The recesses 6 can be formed as furrows 7 having one or more generally helical shoulders with a pitch of 1 mm, a width of for example 0.5 mm and a depth of 0.15 mm. These furrows 7 may, as may be seen in FIG. 1, be parallel but opposed to each other in succeeding recesses 6. These recesses 6 can, as was indicated above, have any desired cross-sectional shape, such as round, rhombus shaped, or can even be elongated.

Once these recesses or indentations 6 have been formed in the oleophilic metal layer 6, they are back-filled with a hydrophilic material, generally at 8. This hydrophilic material 8 is essentially abrasion proof and is put into the recesses 6 by a flame-spraying method or the like. In the preferred embodiment, the hydrophilic material 8 which is flame-sprayed into the indentations or recesses 6 is a ceramic material, such as $CR_2O_3$.

During the flame-spray filling of the recesses or indentations 6 with the ceramic material 8, it is not possible to fill only the recesses 6. Thus the entire outer peripheral surface 4 of the oleophilic metal layer 3 is covered with at least a thin layer 9 of the ceramic material 8. This thin layer 9 will then be removed by a suitable grinding procedure or the like so that the outer peripheral surface 4 of the entire oleophilic metal layer 3 is again exposed, except in the area of back-filled surfaces 10 of the ceramic material 8 which has been placed in the recesses 6. At this stage of the method of forming the roller for a printing machine in accordance with the present invention, the outside surface portion 11 of the metal layer 3 after grinding, and the outside surface portion 12 of the backfills 10 of ceramic material 8 in the recesses are at the same level or height.

Figure 2:
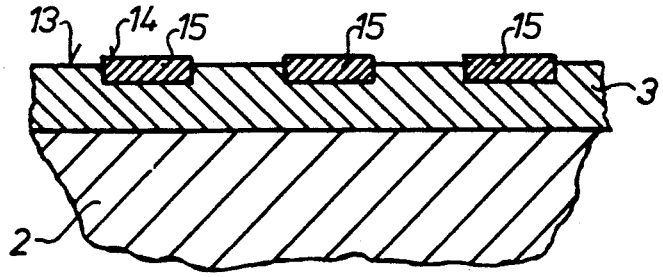
FIG. 2 is a view similar to FIG. 1 and showing the roller after completion of the coating process.

Referring now to FIG. 2, the outer surface of the oleophilic metal layer 3 may now be reduced or lowered to form the final oleophilic transport surfaces 13 or cells of the screened surface ink roller. This reduction or lowering of the oleophilic transport surfaces 13 with respect to the outer surfaces 12 of the backfills 10 of ceramic material 8 may be accomplished by suitable etching or electrochemical chem-milling procedures. The ground off backfill surfaces 15 of the ceramic material 8 form the hydrophilic transport surfaces 14 or cross pieces of the screened ink roller. In the preferred embodiment, the oleophilic transport surfaces 13 are arranged at a depth of 0.03 mm below the outside surface 14 of the abraded or ground off ceramic backfills 15.

While a preferred embodiment of a roller for a printing machine and its method of manufacture in accordance with the present invention has been set forth fully and completely hereinabove, it will be apparent to one of skill in the art that various changes in, for example, the spacing of the recesses, the thickness of the oleophilic metal layer, the size of the roller and the like could be made without departing from the true spirit and scope of the invention which is accordingly to be limited only by the following claims.

What is claimed is:

1. A screened surface ink roller for a printing machine, said roller comprising:

a roller having an outer metallic surface;

a layer of an oleophilic metal secured to said outer metallic surface;

a plurality of recesses in an outer transport surface of said oleophilic metal layer;

a hydrophilic material carried in said recesses, said hydrophilic material having an outer hydrophilic transport surface, said hydrophilic transport surface being at a higher level than said outer transport surface of said oleophilic metal layer.

2. The screened surface ink roller of claim 1 wherein said oleophilic metal is copper.

3. The screened surface ink roller of claim 2 wherein said hydrophilic material is a ceramic.

* * * * *